United States Patent [19]

Chien

[11] 4,389,070

[45] Jun. 21, 1983

[54] RECLINING CHAIR WITH SUPPLEMENTAL TELESCOPING FRAME

[76] Inventor: Wu-Shinn Chien, No. 8, Yue Tsai St., Kaohsiung, Taiwan

[21] Appl. No.: 124,967

[22] Filed: Feb. 27, 1980

[51] Int. Cl.[3] ..... A47C 1/022

[52] U.S. Cl. ..... 297/365; 297/433; 5/39

[58] Field of Search ..... 297/68, 75, 76, 433, 297/434, 365, 440, 377; 5/38, 39

[56] References Cited

U.S. PATENT DOCUMENTS

| | | | |
|---|---|---|---|
| 395,975 | 1/1889 | Hogan | 297/365 |
| 685,371 | 10/1901 | Davis et al. | 297/365 |
| 1,224,982 | 5/1917 | Washeim | 297/433 |
| 2,834,397 | 5/1958 | Kluglein et al. | 297/68 |
| 3,137,868 | 6/1964 | Hoffsis et al. | 5/39 |
| 3,206,775 | 9/1965 | Filson | 297/433 X |

FOREIGN PATENT DOCUMENTS

| | | | |
|---|---|---|---|
| 1307378 | 9/1962 | France | 5/39 |

*Primary Examiner*—Francis K. Zugel
*Attorney, Agent, or Firm*—Holman & Stern

[57] ABSTRACT

A reclining chair has a main frame and a supplemental frame telescoping therefrom. The main frame includes a foot section and a back section pivotally supported thereon and latchable in adjusted positions. The back section includes arcuate slots and the supplemental frame includes horizontal legs telescoping into the main frame and vertical legs connected by pin means to the arcuate slots in the backrest. Spring means bias the horizontal legs toward the main frame and bias the vertical legs upwardly from the supplemental frame so that as the backrest is moved toward the horizontal the horizontal legs are extended and the vertical legs are lowered against the bias of the springs.

2 Claims, 14 Drawing Figures

RECLINING CHAIR WITH SUPPLEMENTAL TELESCOPING FRAME

BACKGROUND OF THE INVENTION

The present invention relates to reclining chairs, and more particularly to recliners having a main frame and a supplemental frame, the latter providing increasing underlying support in direct proportion to the amount of incline imparted to the reclining portion of the chair with the movement of the supplemental frame relative to the main frame being controlled by a pin-and-slot structure carried by both frames.

BRIEF DESCRIPTION OF DRAWINGS

For the purpose that this invention may be clearly understood, an embodiment thereof will now be described by way of example with reference to the accompanying drawings in which.

DESCRIPTION OF THE PREFERRED EMBODIMENT

The recliner of the present invention comprises a main frame including back and foot supporting portions, and a supplemental frame including a head rest.

The main frame is made up of two opposing steel pipes, which are bent to define U-shaped main legs 1A and arm 1B. A cylinder 7 is welded to each main leg 1A alongside, and seat-supporting rods 1C are attached above and span the two cylinders by welding them crosswise so that a sponge or resilient seat can be cupported on these rods. By virtue of their design, the two U-shaped main legs provice steady and safe standing on the floor. Sponge pads or other coatings can be put on the arms.

Figure 7:
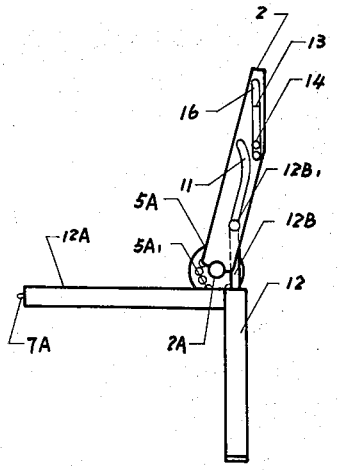
FIG. 7 is a side view of the back portion and the supplemental frame
Figure 8:
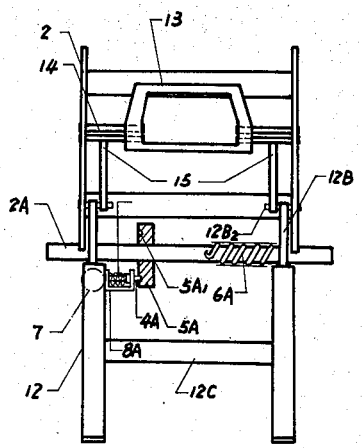
FIG. 8 is a front view of the back portion and the supplemental frame.
Figure 9:
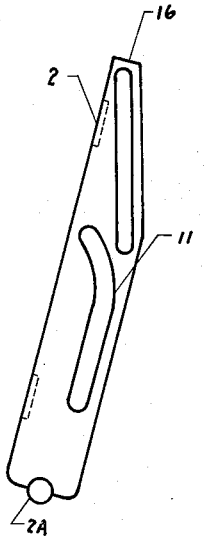
FIG. 9 is a side view of the back portion with the axle.
Figure 10:
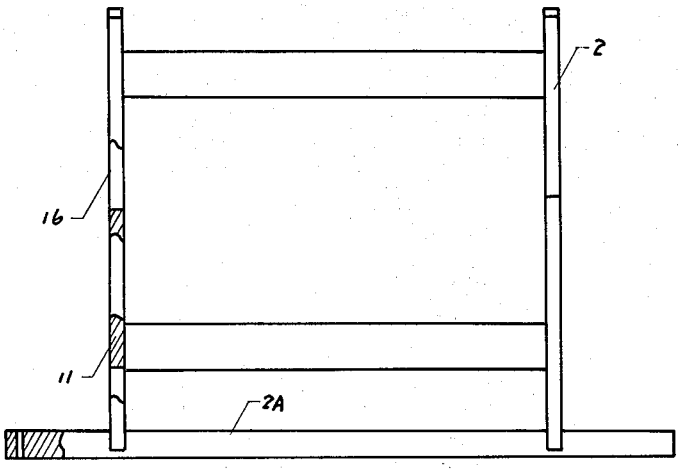
FIG. 10 is a rear view of the back portion with axle.
Figure 11:
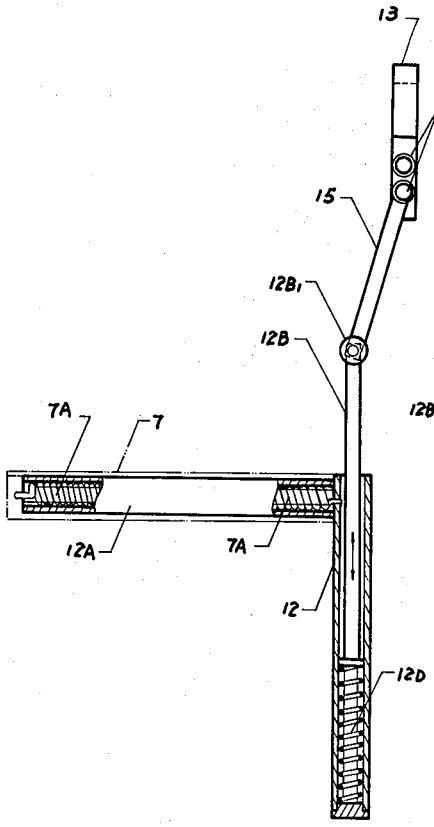
FIG. 11 is a side view of the supplemental frame and head rest.
Figure 12:
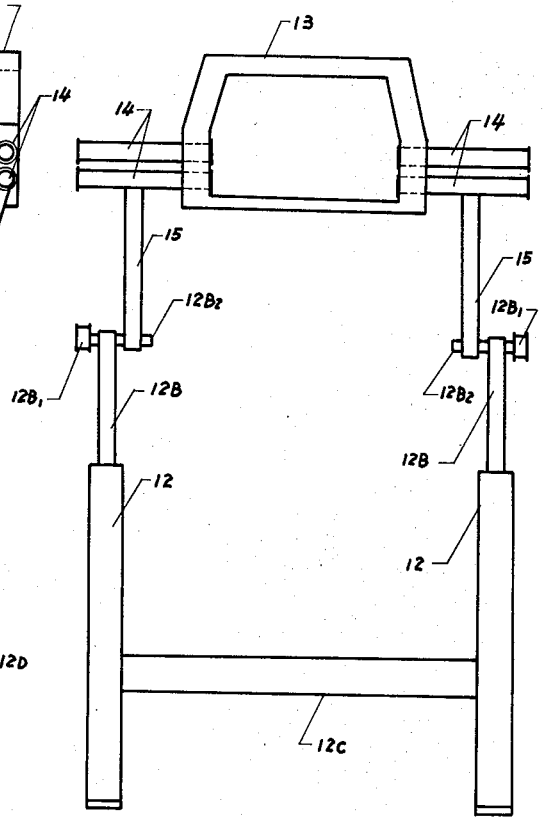
FIG. 12 is a rear view of the supplemental frame and head rest.
Figure 13:
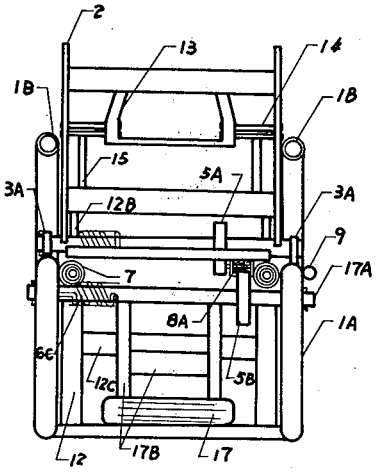
FIG. 13 is a front view of the whole chair.
Figure 14:
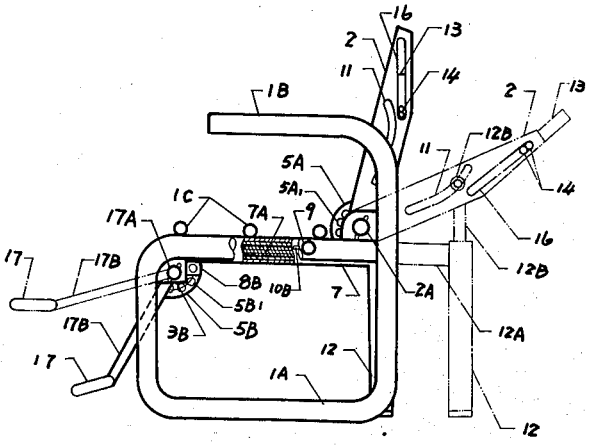
FIG. 14 is a side view of the whole chair.

The back portion of the main frame comprises a back 2 and an axle 2A (Note FIGS. 7–10). The back comprises steel plates fastened by welding, which when assembled support a sponge pad or cushion against which the user leans. The axle 2A is supported at each end by a bearing 3A, the latter being welded on the main frame at the place where the main legs 1A extend upward into and begin to define arms, as shown in the drawings. Bearings 3A permit rotation of the axle 2A about its longtudinal axis. Thus the back 2 can be pushed backward and made sloped.

Figure 1:
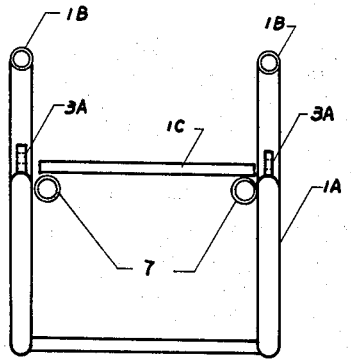
FIG. 1 is the front view of the main frame.
Figure 2:
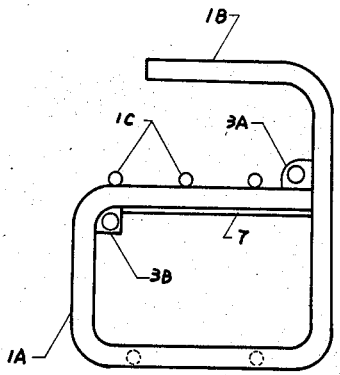
FIG. 2 is the side view of the main frame.
Figure 3:
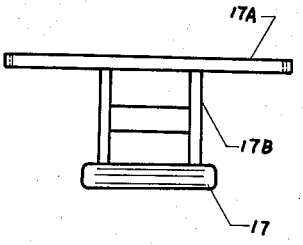
FIG. 3 is the front view of the foot portion.
Figure 4:
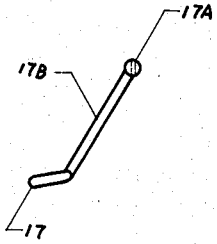
FIG. 4 is the side view of the foot portion.
Figure 5:
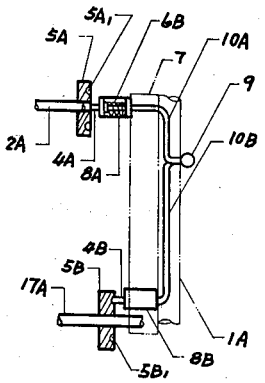
FIG. 5 is a top view of the unlatching device.
Figure 6:
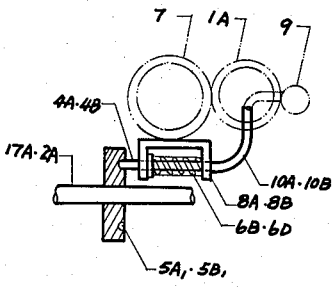
FIG. 6 is a front view of the unlatching device.

As shown in FIGS. 5–8, one end of the axle 2A supports a control wheel 5A, which includes about its surface a number of holes $5A_1$ for locking key 4A to engage. Supported on and wrapped about the other end of axle 2A is torsion spring 6A, which urges the back 2 into an upright position to permit normal sitting. Locking key 4A normally protrudes out of a socket 8A, supported by cylinder 7, a spring 6B urging the locking key 4A into engagement with any of the holes 5A.

An unlatching device comprising wire 10A is coupled to locking key 4A at the outside of the socket 8A. The unlatching device further comprises a controlling ball 9, which enables, when the ball 9 is pulled away from cylinder 7, removal of the locking key 4A out of the engagement with the hole 5A. Then leaning pressure exerted against back 2 will cause backward sloping to desired slant about the axle 2A. Upon release of the ball 9 the locking key 4A will engage the nearest one of the holes $5A_1$, thus preventing the back 2 from falling downward, and keeping the back 2 at a slope which the user desires.

Supplemental frame (see FIGS. 7 and 8) comprises two vertical legs 12, horizontal legs 12A, two sliding rods 12B, two rings $12B_1$ and two pins $12B_2$. Vertical legs 12 are welded at right angles with the horizontal legs 12A, the latter being telescopically movable in cylinder 7. The sliding rods 12B are telescopically fixed within the upper end of vertical legs 12, and are attached at their upper ends by means of pins $12B_2$ and rings $12B_1$ to the back 2, the pins $12B_2$ making sliding engagement with arc-shaped slots 11 disposed in opposing sides of the back 2. Inside each cylinders 7 is a tension spring attached to the end of the horizontal leg 12A for pulling the leg 12A back to its ordinary non-telescoped position when necessary. Inside each vertical leg 12 is a cushion spring 12D for resiliently supporting the inserted rod. The elasticity of these springs assists in the support of the person lying on this chair as well as damping out undesirable motion of the back. A horizontal rod 12C is attached, e.g. by welding, between the two vertical legs for support. When the horizontal legs 12A are in the non-telescoped position, and hence the supplemental frame is disposed adjacent the main frane, vertical legs 12 are shorter than the main leg 1A, and do not touch the floor when in the sitting position. The pin $12B_2$, located at the top of the sliding rod 12B when inserted in the arc-shaped slot 11, slides along the same slot 11. When the control wheel 5A and the locking key 4A are separated, pressure exerted by the user against back 2 will force the slots 11 to press against the pins $12B_2$ to move them upwardly. Such movement of the sliding rods 12B will, accordingly, pull the horizontal legs 12A out of the cylinders 7 against the return action of tension spring 7A.

The head rest comprises of a pillow-supporting frane 13, horizontal rods 14 for fixing the pillow-supporting frane 13, and coupling rods 15. The pillow-supporting frane 13 is made of wood and fixed to adjacent ends of pairs of rods 14. The other ends of rods 14 are inserted into straight slots 16 on the back 2 above arc-shaped slots 11. Substantially vertical coupling rods 15 interconnect rods 14, with the sliding rods 12B at the pins $12B_2$. If the coupling rods 15 receive pushing and pulling action from the sliding rods 12B, the coupling rods 15 will push or pull the rods 14 for pillow-supporting frane 13 along the straight slots 16 upward or downward. A sponge pillow may be placed against the pillow-supporting frame 13.

The foot portion comprises a foot-resting board 17, an axle 17A and a connecting frame 17B. The board 17 and the connecting frame 17B are made of steel pipe bent and welded together. The axle 17A for the foot-resting board 17 is a steel pipe supported at opposing ends by two bearings 3B welded on the front corners of the main legs 1A.

One end of the axle 17A is equipped with a control wheel 5B on which a number of holes $5B_1$ are drilled for receipt of locking key 4B. The locking key 4B extends through the socket 8B, which is fixed on the cylinder 7, and a spring 6D, placed inside the socket 8B, bears against and urges the locking key 4B outward of the socket 8B and into engagement with a surface of the control wheel. The other end of the locking key 4B protrudes out the socket 8B and connects with a wire 10B which is fastened to the controlling ball 9. When the ball 9 is pulled out, and accordingly the wire 10B is pulled, the locking key 4B will be pulled out of engagement with one of the holes $5B_1$ on the control wheel. The force of the torsion spring 6C, fastened to axles 17A and main frane 1A, normally causes axle 17A to rotate thereby urging the foot-resting board 17 to move upward. When it is desired to restore the board 17 to its lowered position the ball 9 is once again pulled out, the board 17 is pressed down to the lowest position, and the ball 9 is thereafter released.

To convert the chair from its normal sitting frame to a reclining frame, the ball 9 is pulled outward, causing the two wires 10A and 10B to pull the locking keys 4A & B out of engagement with the holes $5A_1$ and $5B_1$ on the control wheel 5A and 5B simultaneously. The board 17 will rise upwardly under the force of the spring 6C and pressure exerted by the user causes sliding rods 12B to pull the horizontal legs 12A out of the cylinders 7, and in turn the vertical legs 12 are moved backward. The pillow-supporting frame 13 moves upwardly under the force imparted to the coupling rods 15, the motion of frame 18 being constrained by straight slots 16 in back 2. When the foot-resting board 17 rises, the pillow rises too. When the back of the chair is slanted in a desired manuver, release of the ball 9 causes the cessation of all moving parts, and the chair is maintained in the chosen position. On the other hand, to convert the recliner to a normal sitting frame, the ball 9 is again pulled out, board 17 is pressed down with the user's feet, and the back portion of the chair moves upwardly under the force of the springs 6A and 7A; with vertical legs 12 being pulled forward. When all parts of the chair resume the sitting position, the ball 9 is released, and the chair will gain stability in that position.

I claim:

1. In a reclining chair having a main frame, and a supplemental frame telescopingly supported therefrom for movement between a first position wherein said supplemental frame is disposed adjacent said main frame and a plurality of telescoped positions wherein said supplemental frame is spaced from said main frame, the main frame including foot and back portions each pivotably mounted thereon for movement between raised and lowered positions, the foot and back portions being pivotable about respective axes through a plurality of positions intermediate the raised and lowered positions, and being latchable in any of said raised, lowered or intermediate positions, the improvement comprising:

said back portion including arcuate slots disposed in opposing sides thereof;

said supplemental frame including (1) a pair of horizontal legs telescopingly engaged with, and normally biased through tension means toward, said main frame, and (2) a pair of vertical legs each telescopingly supporting pin means thereon for vertical movement relative to said vertical legs, each said vertical leg carrying a compression spring biasing said pin means away from said supplemental frame;

said pin means being engaged in said slots to cooperate therewith and interconnect said back portion with said supplemental frame during pivotal movement of said back portion relative to said main frame; and means for simultaneously unlatching said foot and back portions from any of said raised, intermediate or lowered positions.

2. In the reclining chair of claim 1, the improvement further comprising:

said back and foot portions each further including an apertured control wheel mounted on said respective axis;

said back and foot portions being normally biased by torsion spring means toward their respective raised positions;

said unlatching means including a first latching key normally biased into engagement with one of said back portion control wheel apertures, a second latching key normally biased into engagement with one of said foot portion control wheel apertures, and handle means connected to both said first and second latching keys for enabling simultaneous unlatching of said back and foot portions relative to said main frame;

and said first and second control wheel being pivotable independently of each other, whereby upon actuation of said unlatching means, both said first and second latching keys are simultaneously removed from engagement with their respective control wheel aperture, thereby making the back and foot portions free for independent pivotal movement.

* * * * *